United States Patent [19]

Cheng

[11] 3,968,058

[45] July 6, 1976

[54] FREE FLOWING NONIONIC INCLUSION COMPOUNDS

[75] Inventor: Bao-Ding Cheng, Highland Park, N.J.

[73] Assignee: Colgate-Palmolive Company, New York, N.Y.

[22] Filed: Oct. 26, 1973

[21] Appl. No.: 409,899

Related U.S. Application Data

[63] Continuation-in-part of Ser. No. 114,675, Feb. 11, 1971, abandoned.

[52] U.S. Cl. ..... 252/544; 252/154; 252/DIG. 1; 260/96.5 R; 260/96.5 C

[51] Int. Cl.[2] ..... C11D 3/08; C11D 3/32

[58] Field of Search ..... 252/544, 154, DIG. 1; 260/96.5 U, 96.5 R

[56] References Cited

FOREIGN PATENTS OR APPLICATIONS

| | | | |
|---|---|---|---|
| 1,041,468 | 8/1962 | Germany | 260/96.5 U |
| 683,383 | 11/1952 | United Kingdom | |

OTHER PUBLICATIONS

Mima, Journal of the Pharmaceutical Society of Japan, vol. 79, No. 7, pp. 857–863, (1959).

Schwartz et al., Surface Active Agents and Detergents, vol. 2, pp. 299–300, (1958).

*Primary Examiner*—Thomas J. Herbert, Jr.
*Attorney, Agent, or Firm*—Herbert S. Sylvester; Murray M. Grill; Kenneth A. Koch

[57] ABSTRACT

Novel urea-ethoxamer inclusion compounds and a method for their production is disclosed. The new method includes mixing of the ethoxamer with a urea-organic solvent slurry and the subsequent addition of small amounts of silica substances before final curing of the mixture. Ethoxamer content of the new inclusion compounds can be as high as about 65 percent by weight. The new compounds are in the form of free flowing powders and are suitable for post addition to spray dried detergent formulations in order to substantially increase the nonionic surfactant content of the particulate detergent product.

4 Claims, No Drawings

FREE FLOWING NONIONIC INCLUSION COMPOUNDS

RELATED APPLICATIONS

This application is a continuation-in-part of Ser. No. 114,675 filed Feb. 11, 1971, now abandoned.

BACKGROUND OF THE INVENTION

The present invention pertains to heavy duty particulate detergent formulations. Specifically the invention provides a method for incorporating relatively large amounts of liquid nonionic surfactants into heavy duty particulate detergent formulations. More specifically, a method for converting liquid nonionic surfactants into free flowing particulate form, suitable for blending with a particulate detergent powder after spray drying, is provided by the invention.

The most commonly used surface active agents in heavy duty detergent formulations are anionic compounds having detersive properties. Typical of these anionic compounds are the higher alkyl mononuclear aromatic sulfonates such as the higher alkyl benzene sulfonates. These synthetic detergents are very effective in removing dirt from textile fabrics when utilized in conjunction with phosphate builders which function to "soften" the water being used and to provide detersive action. However, considerable controversy exists today as to the efficacy of utilizing phosphate compounds in detergent formulations due to their alleged causation of the eutrophication process in lakes, rivers and streams. Although the eutrophication process, wherein an excessive growth of aquatic plant life is promulgated in natural water bodies, is not completely understood, it is alleged that the phosphate compounds present in detergent containing waste water are a prime factor in promoting this phenomenon.

Although nonionic surfactants are not as effective as anionic surfactants in the presence of large amounts of phosphate builders, it has been discovered that when the phosphate content of a detergent formulation is substantially reduced, the nonionic surfactants appear to provide detergency properties that are superior to anionics in the same reduced phosphate content formulation. Apparently the detersive effectiveness of nonionic surfactants is effected much less by water hardness than that of the commonly used anionic surfactants. In the event that the phosphate builders are totally or partially removed from detergents, the incorporation of progressively larger amounts of nonionic surfactants into detergent formulations may become very desirable.

At present, small amounts of nonionic surfactants are added to detergent formulations, primarily to reduce the amount of foam generated during the washing cycle. The most commonly used nonionic surfactants are ethoxylated long carbon chain alcohols. Typically, the nonionic ethoxamer used has a 12 to 18 carbon atom alkyl chain and an average of about 10 to 19 ethylene oxide units. The range of ethylene oxide content that provides the greatest detergency in these surfactants usually results in a nonionic material that is a viscous liquid at room temperature and therefore unsuitable for direct addition to the dry detergent powder. However, it has been found that when a substantial amount, typically above 5% by weight, of nonionic surfactant is incorporated into the detergent slurry before spray drying, a significant air pollution problem is encountered. This problem, known in the industry as "pluming", is manifested as dense black smoke being discharged from the spray tower.

The primary objective of the present invention is to provide a method for converting liquid nonionic surfactants to dry free flowing form so that they may be readily post added to spray dried detergent formulations to thereby significantly increase the nonionic surfactant content of the final detergent product. The maximization of the nonionic surfactant content of the post addable free flowing powder and the selection of particularly suitable carriers for the liquid nonionic materials are important further objectives of the invention.

SUMMARY OF THE INVENTION

Accordingly, the invention provides a method for forming inclusion compounds of urea and liquid ethoxylated long carbon chain alcohols that are free flowing, non-tacky and contain up to about 60 to 65 percent and preferably greater than 50% by weight ethoxamer. The new method, which includes the preparation of a slurry of urea and organic solvent prior to the mixing of the urea and ethoxamer results in a significantly greater weight percent of the ethoxamer in the inclusion compound. Further, the new method includes the addition of a silica substance, preferably microsized silica particles to the urea-ethoxamer blend in an amount from about 1 to 5 percent by weight of the blend before it is completely cured in order to further increase the ethoxamer content of the inclusion compound.

The urea-ethoxamer inclusion compounds produced by the new method, with up to about a 60 to 65 percent by weight ethoxamer content, can be characterized as free flowing powders. As such, they can be readily dry blended with particulate heavy duty detergent powders after they are spray dried. The high ethoxamer content of the new inclusion compounds permits a substantial increase in the nonionic surfactant content of powdered detergents by post addition, thereby avoiding the handling, pluming and tackiness problems characteristic of prior art methods.

DESCRIPTION OF PREFERRED EMBODIMENTS

In accordance with the invention, it is preferred to utilize a methanol-urea slurry in formulating the new inclusion compounds. However, other organic solvents such as benzene, acetone and ethanol have resulted in inclusion compounds containing up to about 50 percent by weight ethoxamer. Free flowing, urea-ethoxamer inclusion compounds prepared in accordance with the new method and employing methanol as the slurry solvent have been obtained with an ethoxamer content as high as about 65 percent by weight. Preferably, the amount of solvent in the urea-solvent slurry is the minimum amount resulting in a viscous mass. Typically, this minimum amount is between about 10 and 20 percent by weight of the slurry mixture.

The particle size of urea used in forming the slurry has been found to be a significant factor in determining the ultimate ethoxamer content of the inclusion compound. It was found that the finer the urea particle size used, the greater the final ethoxamer content of the inclusion compound. Additionally, shorter drying or setting times were realized when the finer urea particles were used. In accordance with a specific aspect of the invention, it is preferred to utilize urea particles that pass through sieve number 200 in the U.S. sieve series (abbreviated hereafter as a particle size of −200 sieve), i.e., a particle size of less than 74 microns, in forming the urea-solvent slurry of the invention. However, it should be noted that ethoxamer loadings of up to about 50 percent by weight have been obtained with urea particles that will pass through a number 100 sieve in the U.S. sieve series but not through a number 200 sieve in the same series (hereafter referred to a particle size range of −100 sieve to +200 sieve).

In accordance with a further specific aspect of the invention, the drying time, i.e., the time at room temperature necessary for the slurry-ethoxamer mixture to harden into a solid, free flowing powder, can be significantly decreased by adding various substances, usually in amounts of less than about 5 percent usually between 1 and 5 percent by weight, to the mixture. The following substances have been found to be effective to various degrees in reducing the drying time of slurry-ethoxamer mixture: submicroscopic pyrogenic silicon dioxide particles (Cab-O-Sil as made available by the Cabot Corporation), sponge-like silica gel (Syloid as made available by the Davison Chemical Div. of W. R. Grace Company) bentonite, anhydrous $Na_2SO_4$, tripolyphosphates (TPP), glycolic acid sodium salt, meta silicate and the sodium salts of nitrilotriacetic acid (NTA). Of these the submicroscopic particles of silicon dioxide and the sponge like silica gel materials proved to be most effective. The bentonite material was quite effective with ethoxamer contents less than about 60 percent by weight. According to a specific aspect of the new method, it has been found that the point in the process at which the solidification aid is added to the urea-ethoxamer slurry is significant. In this regard, it has been found that drying time can be reduced substantially by adding a suitable solidification aid to the slurry-ethoxamer mixture after a substantial portion of the methanol has been permitted to evaporate at room temperature. This usually involves letting the slurry-ethoxamer mixture stand at room temperature for about one hour before the solidification aid is blended into the mixture. Although the method of the invention can be applied to solidification of a wide range of liquid ethoxamers, it is preferred to utilize ethoxamers having an alkyl chain of from about 12 to 18 carbon atoms and an average of from about 10 to 19 ethylene oxide units. Preferred ethoxamers are available under the trade marks Neodol 45–11 and Alfonic 1,618–78. Neodol 45–11 is an ethoxylated alcohol having an alkyl chain of 14 to 15 carbon atoms and an average of 11 ethylene oxide units, manufactured by the Shell Chemical Corporation. Similarly Alfonic 1,618–78 is an ethoxylated fatty alcohol having an alkyl chain of 16 to 18 carbon atoms and an average of 19 ethylene oxide units, manufactured by the Continental Oil Company.

In performing the new method, a slurry of about 10 to 20 weight percent solvent and 80 to 90 weight percent urea in particulate form is prepared. The slurry is then mixed with an amount of ethoxamer sufficient to form a weight ratio of from more than 1/1 to about 3.5/2 with the urea present in the slurry. The mixing of the slurry and ethoxamer blend is preferably accomplished by the application of shearing force and pressure, as with a laboratory mortar and pestle. The slurry-ethoxamer blend is then permitted to stand at room temperature for about one hour. During this time a substantial portion of the solvent evaporates and the blend, although still wet, becomes harder and dryer then when initially blended. A solidification aid can then be added to the slurry-ethoxamer blend. The solidification aid is thoroughly mixed into the blend in small increments until a fine dry powder results. Typically, fine dry powder is obtained when the solidification aid is present in an amount less than about 5 percent by weight of the final mixture, and after evaporation of at least 99 percent of the solvent. The resulting free flowing powder contains a finite amount of solvent, typically less than about 1 percent by weight of the inclusion compound.

In accordance with the foregoing procedure, 2 ml of methanol was mixed with 5 grams of −200 sieve urea particles to form a slurry. Approximately 5 to 9.3 grams of Neodol 45–11 ethoxamer was gradually and thoroughly mixed with the ureamethanol slurry. A substantial portion of the methanol solvent was then evaporated from the mixture by letting it stand at room temperature for about 1 hour. Subsequent to the hour standing time the blend was still wet, although substantially harder and dryer than when initially blended. At this point in the procedure, about 0.5 grams of a silica substance, typically Cab-O-Sil or Syloid, was added to, and blended with, the still wet slurry-ethoxamer mixture in small increments until a fine dry powder was obtained.

The free flowing powder produced in accordance with the foregoing techniques and containing from about 50 to about 65 percent by weight of a detersive nonionic surfactant is a very suitable post additive for spray dried detergent powders. The new process overcomes the crutcher gelation pluming and handling problems that arise when attempts are made to substantially increase the nonionic surfactant content of spray dried detergent formulations above about 5% by weight. The free flowing powder produced by the new method can be post-added to spray dried detergent formulations to substantially increase nonionic surfactant content. For example, with facilities for post-adding 20 weight percent of a powdered detergent formulation, the nonionic surfactant content of the final formulation can be raised from the typical 2–5 percent by weight to about 15 to 20 percent by weight.

The foregoing specific examples and preferred embodiments should be considered merely as being illustrative of the invention. Consequently, reference should be made to the following claims in determining the full scope of the invention.

I claim:

1. The method of forming a free flowing particulate blend of urea and a liquid ethoxylated long carbon chain alcohol having an alkyl chain of from about 12 to about 18 carbon atoms and an average of about 10 to about 19 ethylene oxide units, comprising the steps of a. preparing a slurry of particulate urea having a particle size less than 74 microns and methanol b. said slurry consisting essentially of from about 80 to 90% urea and from about 10 to about 20% methanol, by weight c. mixing said slurry with said liquid ethoxylated alcohol, in a weight ratio of alcohol to urea of at least 3:2 d. evaporating substantially all of said methanol from the mixture of said slurry and said ethoxylated alcohol, and e. adding microsized silica particles to said slurry ethoxylated alcohol mixture prior to said evaporating step.

2. The method of claim 1 wherein said silica particles comprise from about 1% to about 5 percent by weight of said free flowing particulate blend.

3. The method of claim 1 wherein said microsized silica particles are chosen from the group consisting of pyrogenic silicon dioxide and sponge-like silica gel.

4. A free flowing particulate material, comprising a. an inclusion compound of urea and liquid nonionic surfactant chosen from the group consisting of ethoxylated alcohols having an alkyl chain of from about 12 to about 18 carbon atoms and an average of about 10 to about 19 ethylene oxide units, b. from about 1% to about 5% by weight of microsized silica particles chosen from the group consisting of pyrogenic silicon dioxide and sponge-like silica gel.

c. said inclusion compound including a finite amount of methanol not exceeding 1% by weight, d. said inclusion compound including at least about 60% by weight of said ethoxylated alcohol.

* * * * *